US008408609B2

(12) United States Patent
Brojanac

(10) Patent No.: US 8,408,609 B2
(45) Date of Patent: Apr. 2, 2013

(54) SAFETY LOCKOUT HASP

(75) Inventor: Michael Brojanac, Jackson, WI (US)

(73) Assignee: Master Lock Company LLC, Oak Creek, WI (US)

( * ) Notice: Subject to any disclaimer, the term of this patent is extended or adjusted under 35 U.S.C. 154(b) by 241 days.

(21) Appl. No.: 12/991,473

(22) PCT Filed: May 20, 2009

(86) PCT No.: PCT/US2009/044628

§ 371 (c)(1),
(2), (4) Date: Nov. 8, 2010

(87) PCT Pub. No.: WO2009/143214

PCT Pub. Date: Nov. 26, 2009

(65) Prior Publication Data

US 2011/0057461 A1 Mar. 10, 2011

Related U.S. Application Data

(60) Provisional application No. 61/054,577, filed on May 20, 2008.

(51) Int. Cl.
*E05B 39/02* (2006.01)
*E05B 39/00* (2006.01)

(52) U.S. Cl. ..... 292/285; 292/288; 292/307 R; 70/14

(58) Field of Classification Search ..... 292/281–288, 292/307 R, 307 B, 327–331, DIG. 17; 70/2, 70/14, 18, 50, 51, 53, DIG. 63
See application file for complete search history.

(56) References Cited

U.S. PATENT DOCUMENTS

| | | | | | |
|---|---|---|---|---|---|
| 282,019 | A | * | 7/1883 | Williams | 292/329 |
| 1,377,413 | A | * | 5/1921 | Dwelle | 70/200 |
| 1,937,743 | A | * | 12/1933 | Brooks | 292/328 |
| 1,948,255 | A | * | 2/1934 | Brooks | 292/328 |
| 1,999,718 | A | * | 4/1935 | Brooks | 292/328 |
| 3,372,952 | A | * | 3/1968 | Newton | 292/307 R |
| 4,437,692 | A | | 3/1984 | Halopoff | |
| 4,655,487 | A | * | 4/1987 | Korn et al. | 292/57 |
| 4,864,834 | A | * | 9/1989 | Waite | 70/14 |
| 4,911,486 | A | * | 3/1990 | Anderson | 292/148 |
| 5,076,531 | A | * | 12/1991 | Delaney | 248/552 |

(Continued)

OTHER PUBLICATIONS

International Search Report and Written Opinion for International Application No. PCT/US2009/0044628, dated Jul. 9, 2009.

(Continued)

*Primary Examiner* — Carlos Lugo
(74) *Attorney, Agent, or Firm* — Calfee, Halter & Griswold LLP

(57) ABSTRACT

A safety lockout hasp includes a shackle member having a first shackle leg and a second shackle leg, and first and second clasp members pivotally secured to the first shackle leg. The first clasp member includes an apertured flange, and the second clasp member includes a cutout portion positioned to receive the apertured flange therethrough when the first and second clasp members are in a closed position in which at least one of the first and second clasp members engages the second shackle leg. When the first and second clasp members are in the closed position and a lockable retaining member is inserted through a lockout aperture in the apertured flange, withdrawal of the apertured flange from the cutout portion is prevented, thereby securing the first and second clasp members in the closed position.

16 Claims, 8 Drawing Sheets

U.S. PATENT DOCUMENTS

| | | | | |
|---|---|---|---|---|
| 5,524,462 | A | 6/1996 | Loughlin | |
| 5,544,505 | A * | 8/1996 | McIntosh et al. | 70/18 |
| 6,036,240 | A | 3/2000 | Hamilton et al. | |
| 6,164,097 | A * | 12/2000 | McBryde | 70/58 |
| 6,176,109 | B1 | 1/2001 | Tsui | |
| 6,327,878 | B1 * | 12/2001 | Levenson | 70/14 |
| 6,708,532 | B2 * | 3/2004 | Winland | 70/2 |
| 7,118,144 | B2 * | 10/2006 | Anderson | 292/307 R |
| 7,370,892 | B2 * | 5/2008 | Collingham | 292/329 |
| 2006/0162403 | A1 | 7/2006 | Handel | |

OTHER PUBLICATIONS

Office Action from Canadian Patent Application No. 2,724,490 dated Aug. 9, 2012.

* cited by examiner

SAFETY LOCKOUT HASP

CROSS REFERENCE TO RELATED APPLICATION

This application claims the benefit of U.S. Provisional Patent Application Ser. No. 61/054,577, entitled "SAFETY LOCKOUT HASP" and filed May 20, 2008, the entire contents of which are incorporated herein by reference, to the extent that they are not conflicting with the present application.

BACKGROUND

Security devices, such as for example, padlocks and other types of conventional locks are known in the art. Many security devices are provided for restricting access to equipment and control instruments, including, for example, electrical components, such as switches, dials and push buttons, and fluid system components, such as valves and pressure regulators. Industrial and commercial equipment are often provided with a lockout feature (e.g., a locking bracket or similar structure) to facilitate the restriction of access to, or lockout of, the equipment. The equipment's lockout feature typically includes a hasp or other such apertured member or members configured to receive a shackle (or cable or other retaining member) of a lock to prevent movement of the apertured member with respect to another portion of the lockout feature, thereby preventing access to, or operation of, the equipment.

In some applications, it may be desirable to require the authorization of multiple technicians or other authorized personnel to allow access to, or operation of, a locked out piece of equipment. While a piece of equipment's lockout feature may be sized to retain multiple locks, a safety lockout hasp may instead be provided to be secured to the apertured member. A conventional safety lockout hasp includes a shackle to be secured to the equipment's lockout feature, and one or more apertures for receiving shackles (or other lockable retaining members) of one or more locks. Each of the inserted lockable retaining members prevents withdrawal of the shackle from the equipment's lockout feature, thereby requiring removal of all of the lockable retaining members from the safety lockout hasp to remove the lockout hasp from the equipment's lockout feature to allow access to, or operation of, the equipment.

FIGS. 1 and 2 illustrate a conventional safety lockout hasp 20 including first and second clasp members 21*a*, 21*b* hingedly secured to a shackle member 25 and retained on the shackle by a flanged end 24 and a retaining ring 26. The clasp members 21*a*, 21*b* are rotatable about the shackle 25 between a closed position (FIG. 1) and an open position (FIG. 2). In the closed position, apertures 27*a*, 27*b* of the first and second clasp members 21*a*, 21*b* align to receive lockable retaining members of one or more locks (not shown), thereby securing the clasp members in a closed position relative to the shackle 25. Insertion of one or more lockable retaining members through the aligned apertures 27*a*, 27*b* prevents rotation of the clasp members 21*a*, 21*b* to the open position for removal of the lockout hasp 20 from the lockout feature.

Depending on the size of the lockable retaining members used with the safety lockout hasp 20 of FIGS. 1 and 2, the clasp members 21*a*, 21*b* may be slightly rotatable with respect to the shackle 25 even when one or more locks are secured through the aligned apertures 27*a*, 27*b*.

SUMMARY

The present application contemplates safety lockout hasps for use with equipment or devices. According to an inventive aspect of the present application, a safety lockout hasp may be provided with first and second pivotable clasp members configured to be lockable a closed position to engage a shackle member to prevent withdrawal of the shackle member from a hasp or other otherwise accessible opening in the equipment or device. In one embodiment, an apertured flange of one of the clasp members extends through a corresponding cutout in the other of the clasp members, such that insertion of a lockable retaining member through a lockout aperture in the apertured flange prevents separation of the clasp members from the shackle member for withdrawal of the shackle member.

Accordingly, in one embodiment, a safety lockout hasp includes a shackle member having a first shackle leg and a second shackle leg, and first and second clasp members pivotally secured to the first shackle leg. The first clasp member includes an apertured flange, and the second clasp member includes a cutout portion positioned to receive the apertured flange therethrough when the first and second clasp members are in a closed position in which at least one of the first and second clasp members engages the second shackle leg. When the first and second clasp members are in the closed position and a lockable retaining member is inserted through a lockout aperture in the apertured flange, withdrawal of the apertured flange from the cutout portion is prevented, thereby securing the first and second clasp members in the closed position.

BRIEF DESCRIPTION OF THE DRAWINGS

Further features and advantages of the invention will become apparent from the following detailed description made with reference to the accompanying drawings, wherein.

DETAILED DESCRIPTION

The Detailed Description of the Invention merely describes preferred embodiments of the invention and is not intended to limit the scope of the claims in any way. Indeed, the invention as claimed is broader than and unlimited by the preferred embodiments, and the terms used in the claims have their full ordinary meaning.

According to an inventive aspect of the present application, a safety lockout hasp includes a first rotatable clasp member having one or more apertured flanges that are received through one or more corresponding cutouts in a second rotatable clasp member when the clasp members are in a closed (or shackle closing) position. When one or more lockable retaining members are secured through the one or more apertured flanges, withdrawal of the flange from the corresponding cutout is prevented and the safety lockout hasp is secured in the closed position.

Figure 4A:
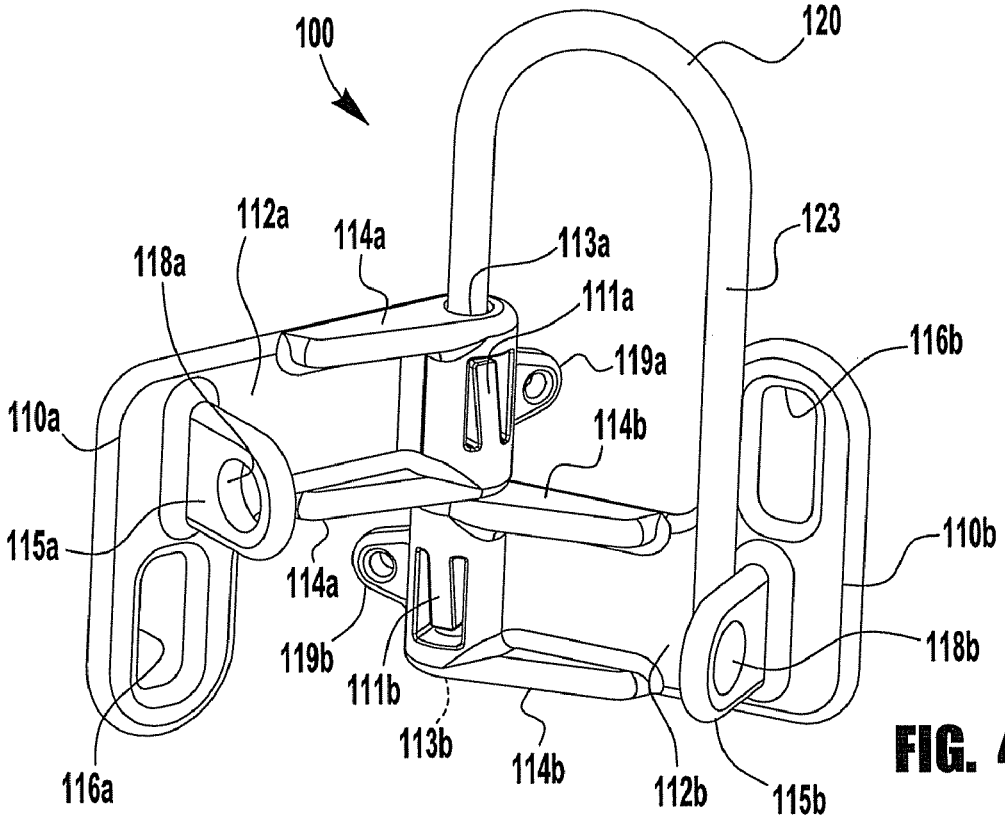
FIG. 4A illustrates a front perspective view of the safety lockout hasp of FIG. 3A, shown in an open position.
Figure 4B:
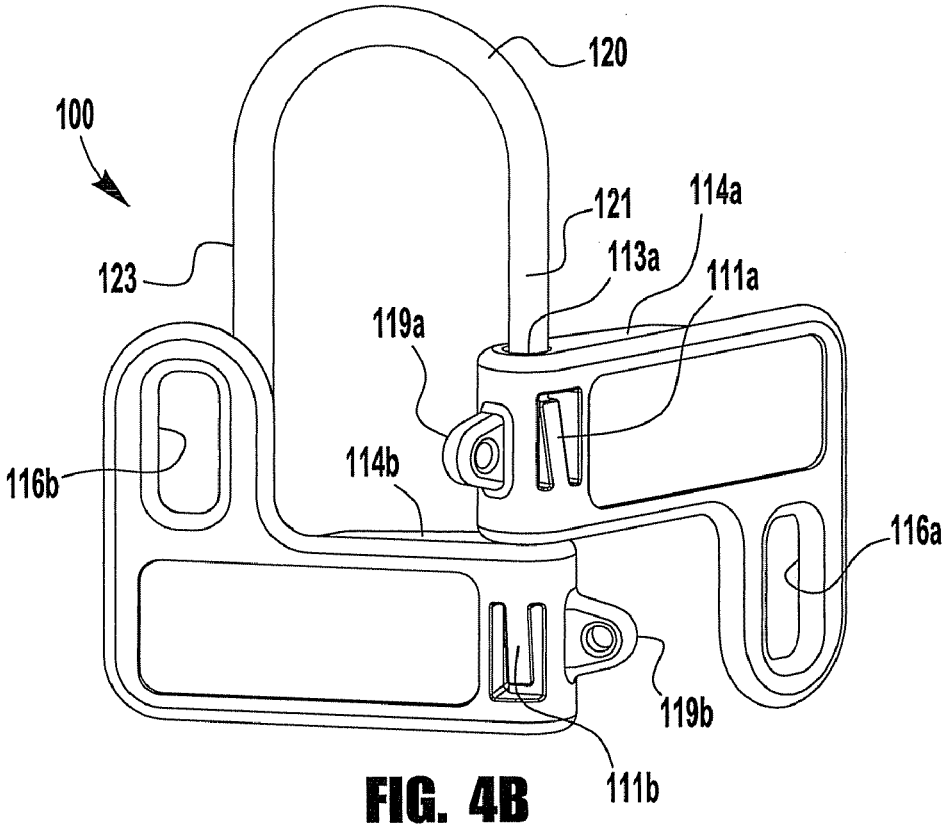
FIG. 4B illustrates a rear perspective view of the safety lockout hasp of FIG. 3A, shown in the open position.
Figure 5A:
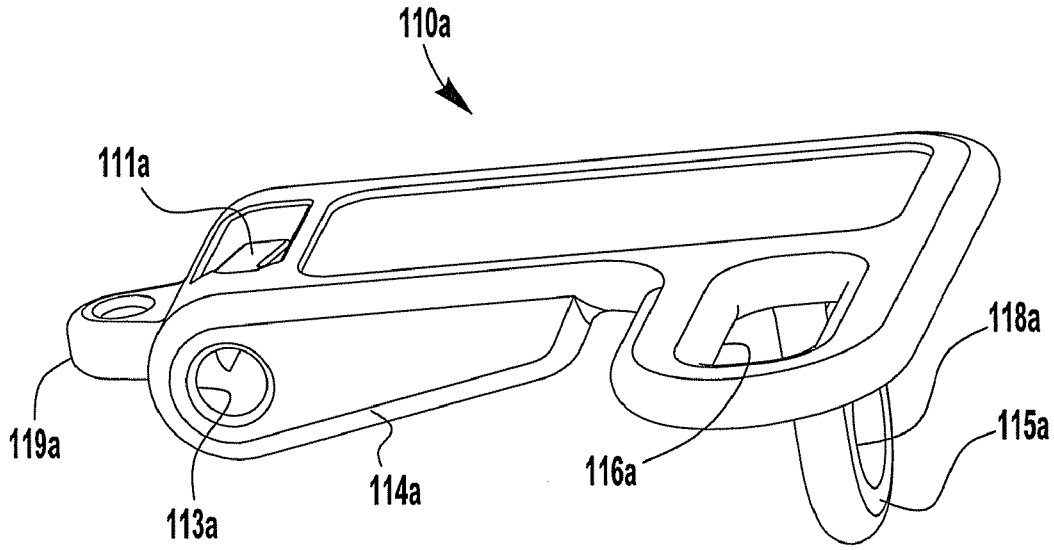
FIG. 5A illustrates a perspective view of a clasp member of the safety lockout hasp of FIG. 3A.
Figure 5B:
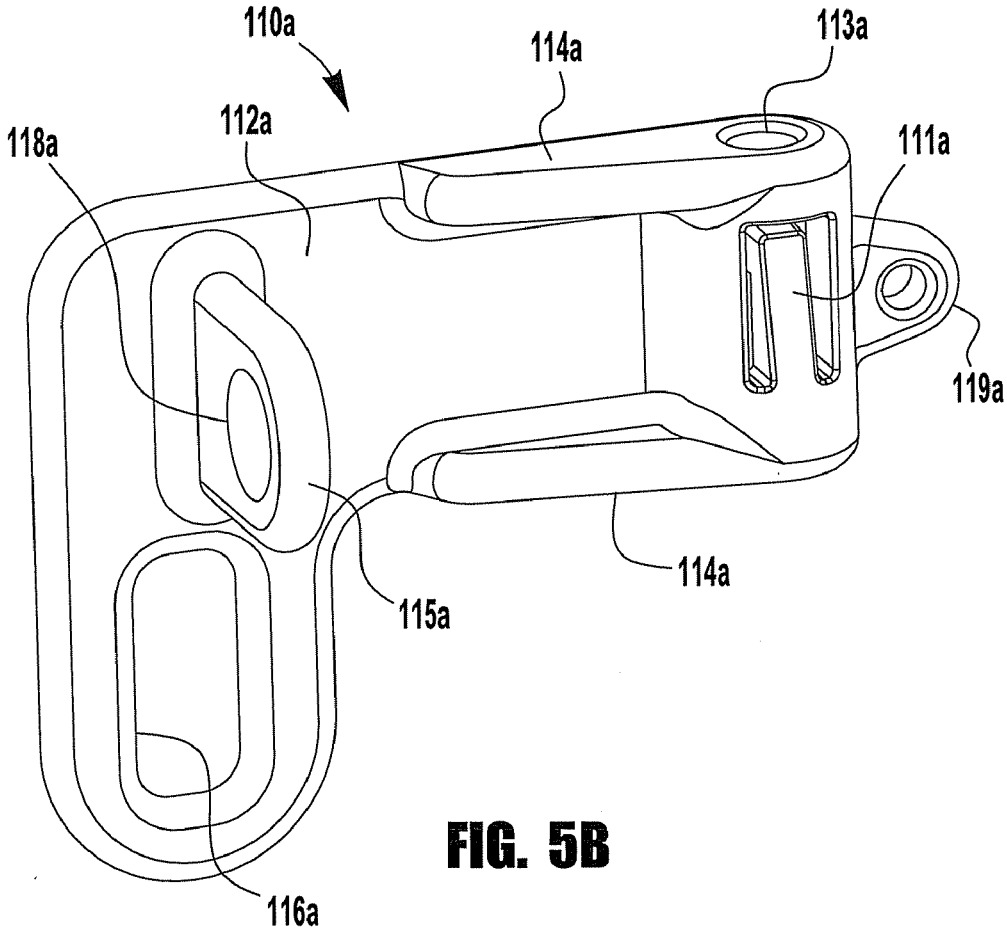
FIG. 5B illustrates another perspective view of the clasp member of the safety lockout hasp of FIG. 3A.

FIGS. 3A-4B illustrate various views of an exemplary safety lockout hasp 100 including many of the inventive features described herein. The lockout hasp 100 includes first and second clasp members 110*a*, 110*b* pivotally or hingedly secured to a shackle member 120. The clasp members 110*a*, 110*b* are rotatable about the shackle between a closed position (as shown in FIGS. 3A-3H) and an open position (FIGS. 4A and 4B). Each clasp member 110*a*, 110*b* includes an apertured flange 115*a*, 115*b* that extends laterally from (or substantially perpendicular to) a shackle abutting portion 112*a*, 112*b* of the clasp member 110*a*, 110*b*. Each clasp member 110*a*, 110*b* further includes a cutout portion 116*a*, 116*b* sized and oriented to receive the apertured flange 115*a*, 115*b* of the opposing clasp member 110*a*, 110*b* therethrough when the clasp members 110*a*, 110*b* are in the closed position. When one or more lockable retaining members (e.g., a padlock shackle, locking cable, or plastic tie) are secured through one or both of the lockout apertures 118*a*, 118*b* of the flanges 115*a*, 115*b*, withdrawal of the flanges 115*a*, 115*b* from the corresponding cutout portions 116*a*, 116*b* is prevented, thereby securing the clasp members 110*a*, 110*b* in a closed position. This prevents removal of the lockout hasp 100 from the equipment lockout feature to which the lockout hasp 100 is secured. The lockout apertures 118*a*, 118*b* may be sized large enough to accommodate a range of sizes of retaining members (including, for example, an 8 mm diameter shackle), but small enough to prevent excessive rotation of the locked clasp members (and resulting separation from the shackle member 120) when a smaller retaining member (such as, for example, a plastic tie) is secured through the aperture 118*a*, 118*b*.

Figure 1:
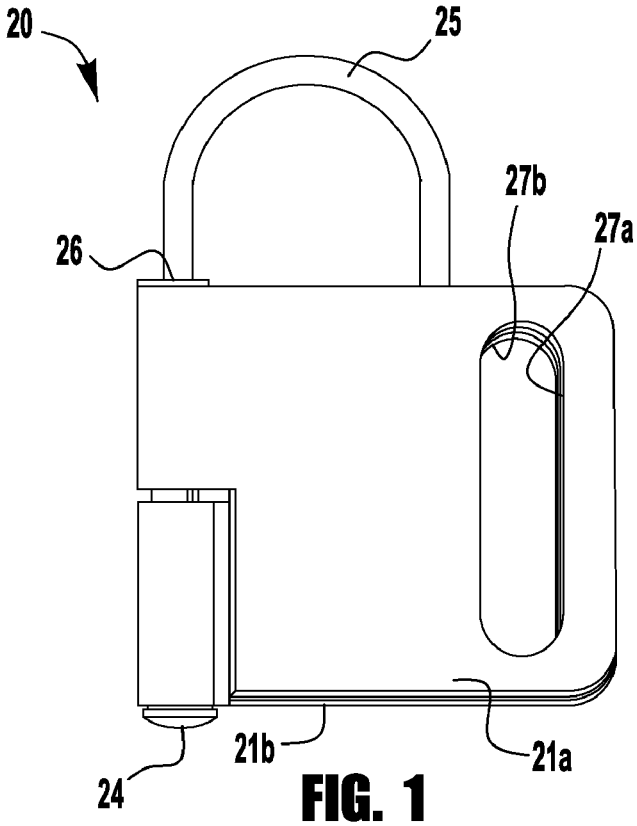
FIG. 1 PRIOR ART
FIG. 1 illustrates a front view of a conventional safety lockout hasp, shown in a closed position.
Figure 2:
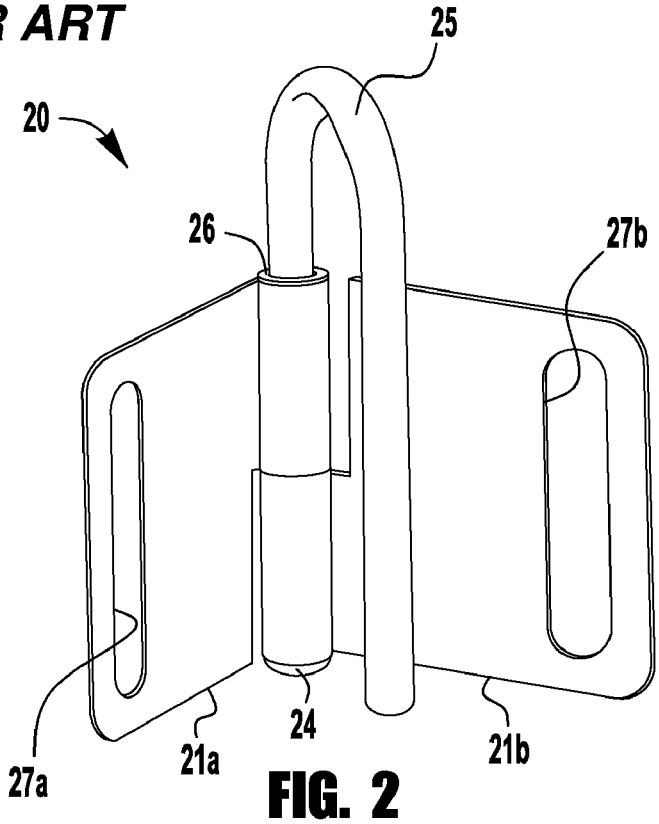
FIG. 2 PRIOR ART
FIG. 2 illustrates a side perspective view of the safety lockout hasp of FIG. 1, shown in an open position.
Figure 3A:
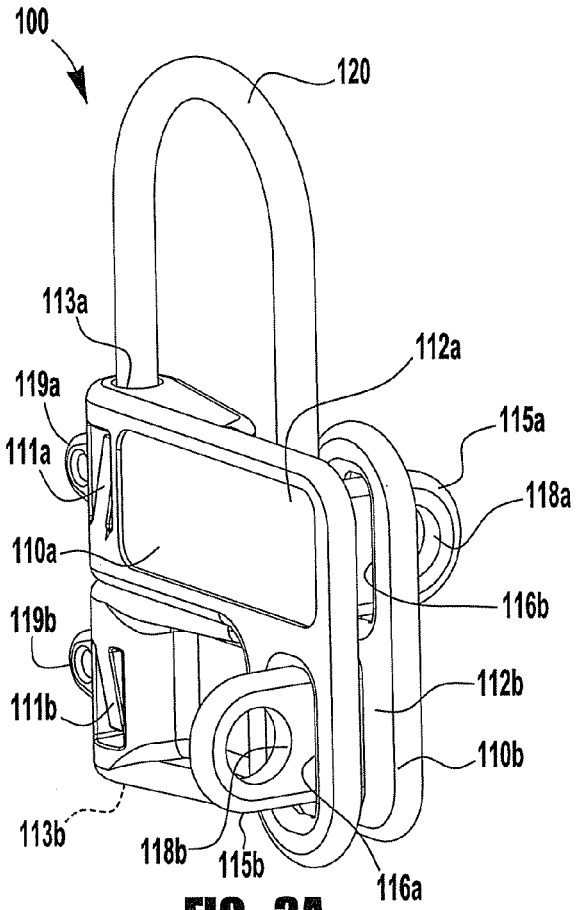
FIG. 3A illustrates a front perspective view of a safety lockout hasp, shown in a closed position.
Figure 3B:
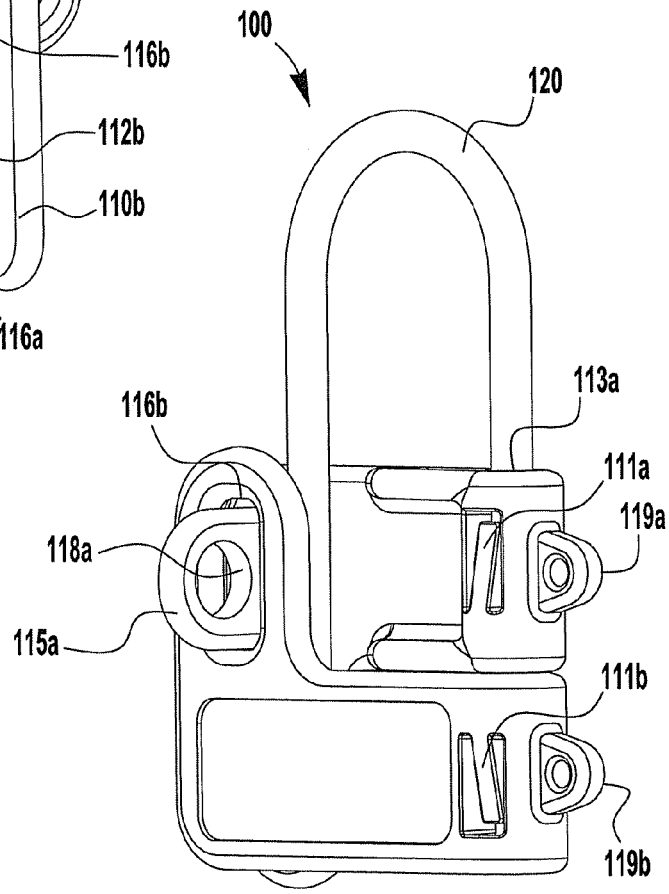
FIG. 3B illustrates a rear perspective view of the safety lockout hasp of FIG. 3A, shown in the closed position.
Figure 3D:
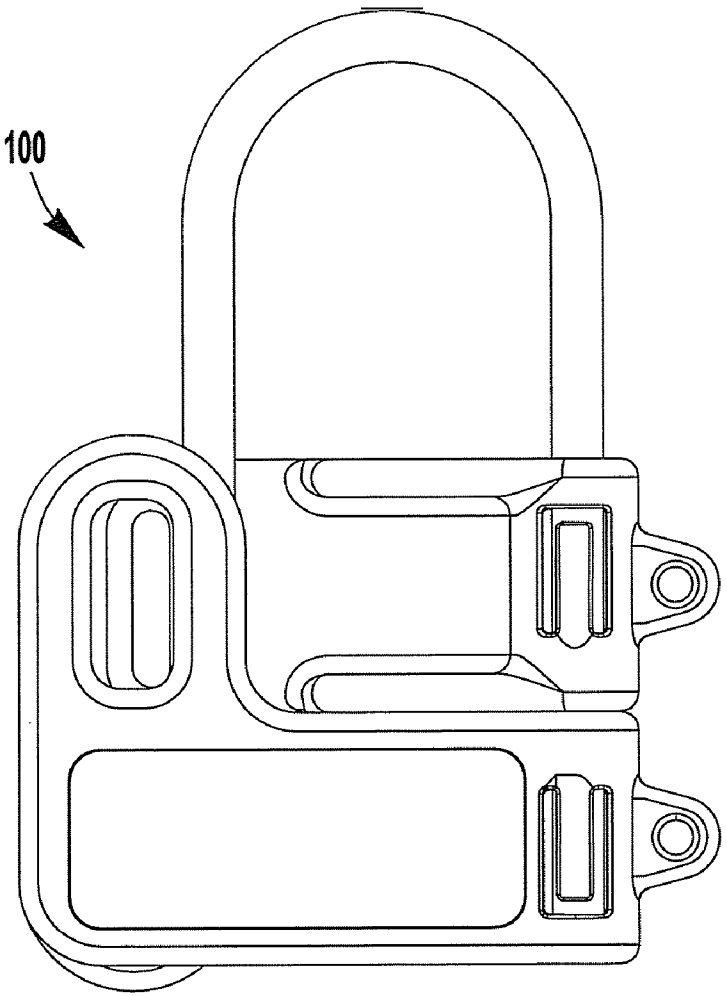
FIG. 3D illustrates a rear elevational view of the safety lockout hasp of FIG. 3A, shown in the closed position.
Figure 3C:
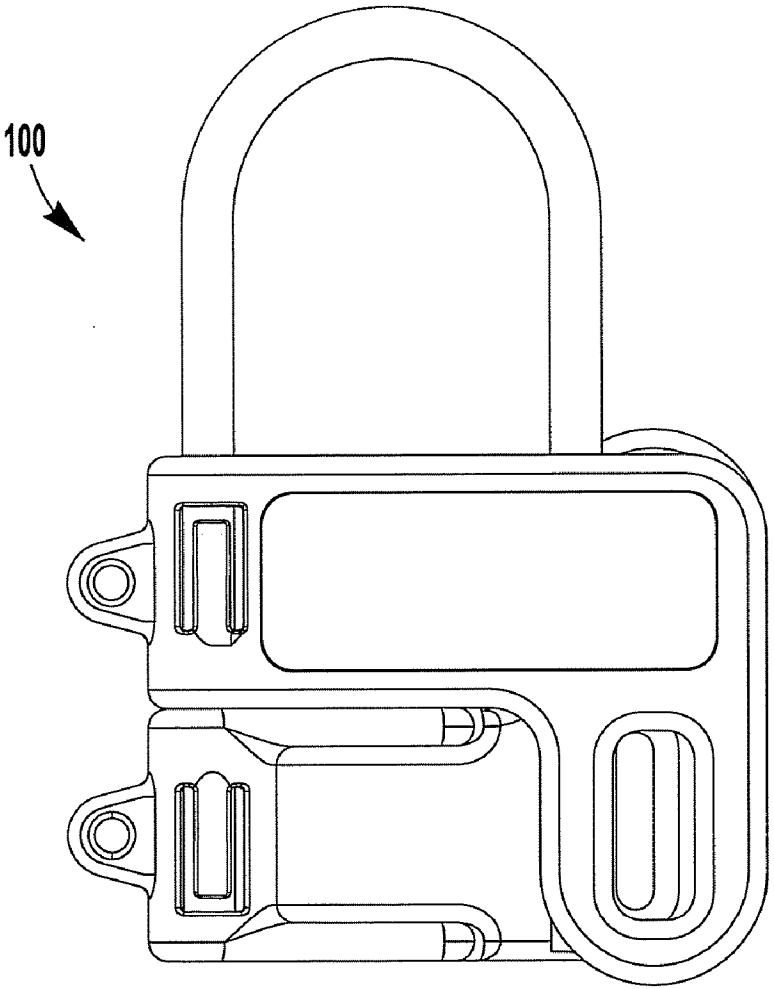
FIG. 3C illustrates a front elevational view of the safety lockout hasp of FIG. 3A, shown in the closed position.
Figure 3E:
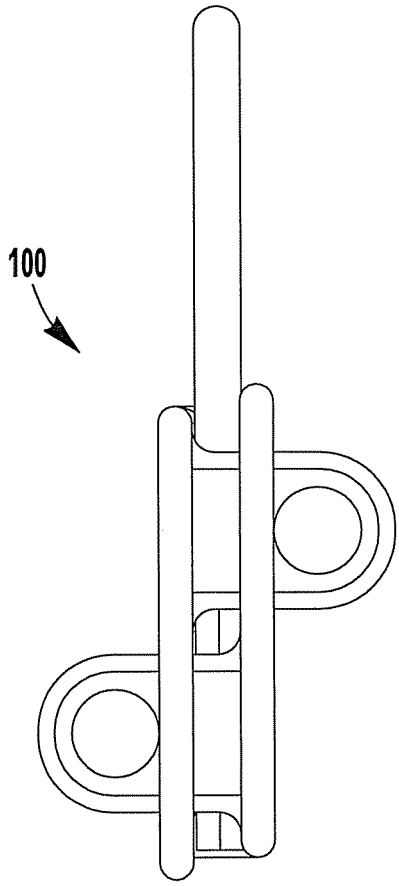
FIG. 3E illustrates a right side elevational view of the safety lockout hasp of FIG. 3A, shown in the closed position.
Figure 3F:
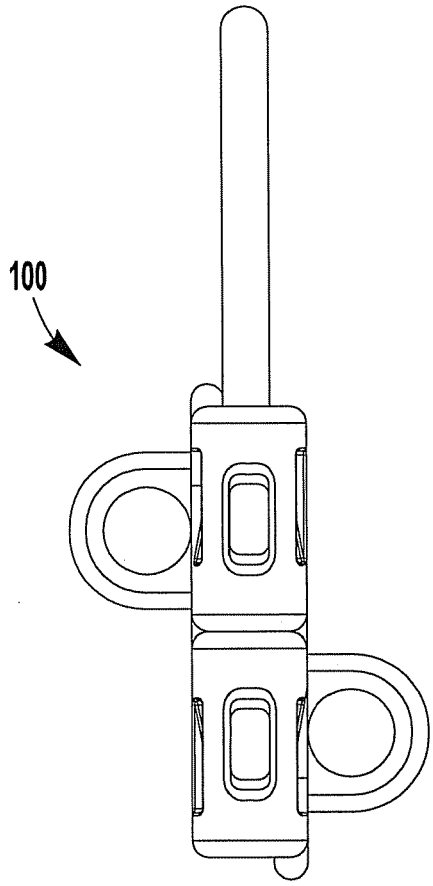
FIG. 3F illustrates a left side elevational view of the safety lockout hasp of FIG. 3A, shown in the closed position.
Figure 3G:
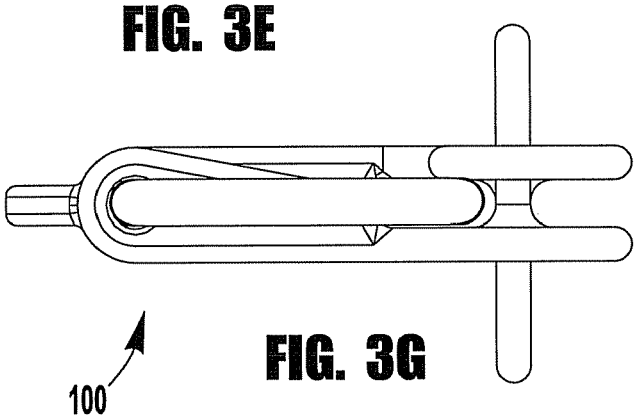
FIG. 3G illustrates a top plan view of the safety lockout hasp of FIG. 3A, shown in the closed position.
Figure 3H:
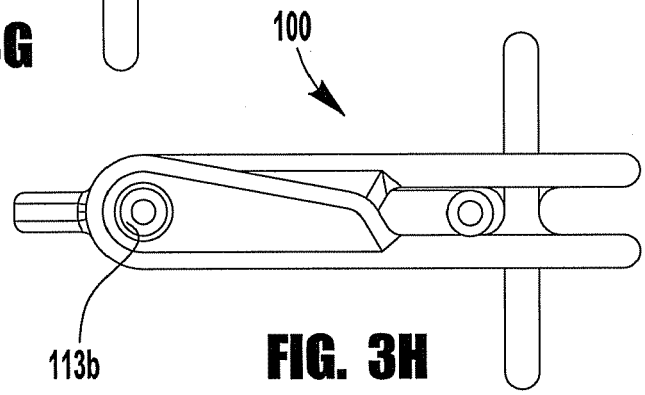
FIG. 3H illustrates a bottom plan view of the safety lockout hasp of FIG. 3A, shown in the closed position.

Many different configurations may be utilized to axially secure the clasp members 110*a*, 110*b* on the shackle 120 while permitting rotation of the clasp members 110*a*, 110*b* about the shackle 120. In one embodiment (as shown in FIGS. 1 and 2), an end of the shackle may be flanged or peened to retain the clasp members on the shackle, and a retaining ring may be installed on the shackle to prevent movement of the clasp members upward on the shackle. In another embodiment, one of the shackle and the clasp members may be provided with circumferential grooves, and the other of the shackle and the clasp members may be provided one or more projections positioned to be retained in the corresponding grooves to axially secure the clasp members on the shackle while permitting rotation thereabout.

Figure 6:
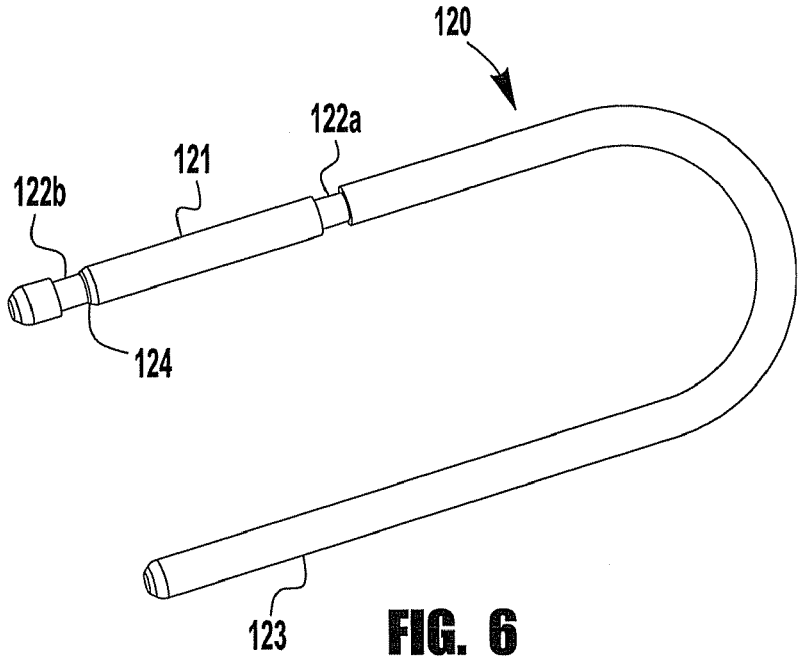
FIG. 6 illustrates a perspective view of the shackle of the safety lockout hasp of FIG. 3A.

In the embodiment of FIGS. 3A-4B, the clasp members 110*a*, 110*b* each include an axially extending passage 113*a*, 113*b* for insertion of a first shackle leg 121 therethrough, and inwardly biased fingers 111*a*, 111*b* of the clasp members 110*a*, 110*b* that extend into the corresponding passage 113*a*, 113*b*. As shown in FIG. 6, the first shackle leg 121 includes first and second circumferential grooves 122*a*, 122*b*. During insertion of the first shackle leg 121 through the passages 113*a*, 113*b* of the clasp members, the fingers 111*a*, 111*b* flex outward against the shackle 120 and snap into engagement with the corresponding grooves 122*a*, 122*b* upon alignment with the grooves. As shown in FIG. 6, the second groove 122*b* may be provided with a chamfered upper edge 124 to allow the first clasp member 110*a* to be more easily slid past the second groove 122*b* for subsequent snap-fit engagement with the first groove 122*a*.

While the shackle 120 may be provided in many different sizes, in one embodiment, the shackle is approximately 4 mm in diameter, to accommodate, for example, the smaller standard lockout apertures of conventional ISO/DIN type equipment. By providing a shackle 120 having a smaller diameter than the size of padlock shackle (or other retaining member) accommodated by the lockout apertures 118*a*, 118*b*, the safety lockout hasp 100 may be used as a type of adapter for padlocks (or other locks) having shackles (or other retaining members) that are too large to fit in a smaller lockout aperture.

The first and second clasp members 110*a*, 110*b* may be provided in a wide variety of combinations of sizes and shapes. As one example (not shown), a safety lockout hasp may be provided with all of its apertured flanges on a first clasp member, with corresponding cutouts provided on the second clasp member. In the illustrated embodiment, each clasp member 110*a*, 110*b* is provided with one apertured flange 115*a*, 115*b* and one cutout portion 116*a*, 116*b* (e.g., a slot, hole, or notch) to accommodate the apertured flange of the other clasp member. As shown, the first and second clasp members 110*a*, 110*b* may be substantially identical, which may reduce costs associated with tooling, manufacturing, and storage of inventory. In other embodiments (not shown), either or both of the clasp members may be provided with multiple apertured flanges, flanges with multiple lockout apertures, and/or cutout portions to accommodate the apertured flange arrangements.

While the lockout hasp components may be provided in many different materials, in one embodiment, the shackle 120 and clasp members 110*a*, 110*b* are provided in plastic or some other dielectric or non-conductive material, for example, to reduce the risk of electrical shock to the user. In other embodiments, these components may be provided in metals, such as steel or aluminum, or in some other suitable material. The safety lockout hasp components may be provided in many different sizes, shapes, and dimensional configurations, for example, to accommodate different equipment lockout apertures and padlocks or other retaining members.

Additional features may also be provided. For example, as shown in the illustrated embodiment, a loop 119*a*, 119*b* may be provided on each clasp member 110*a*, 110*b* to facilitate fastening of an identification tag to the lockout device. As another example, a slight interference fit may be provided between the apertured flanges 115*a*, 115*b* and a second shackle leg 123 when the clasp members 110*a*, 110*b* are in a closed position, to retain the clasp members in the closed position during installation. As still another example, laterally extending wall members 114*a*, 114*b* (FIG. 4A) may be provided on each clasp member 110*a*, 110*b* to minimize the open space between the clasp members when in the closed position, for example, to inhibit efforts to pry the locked clasp members 110*a*, 110*b* apart.

Figure 7:
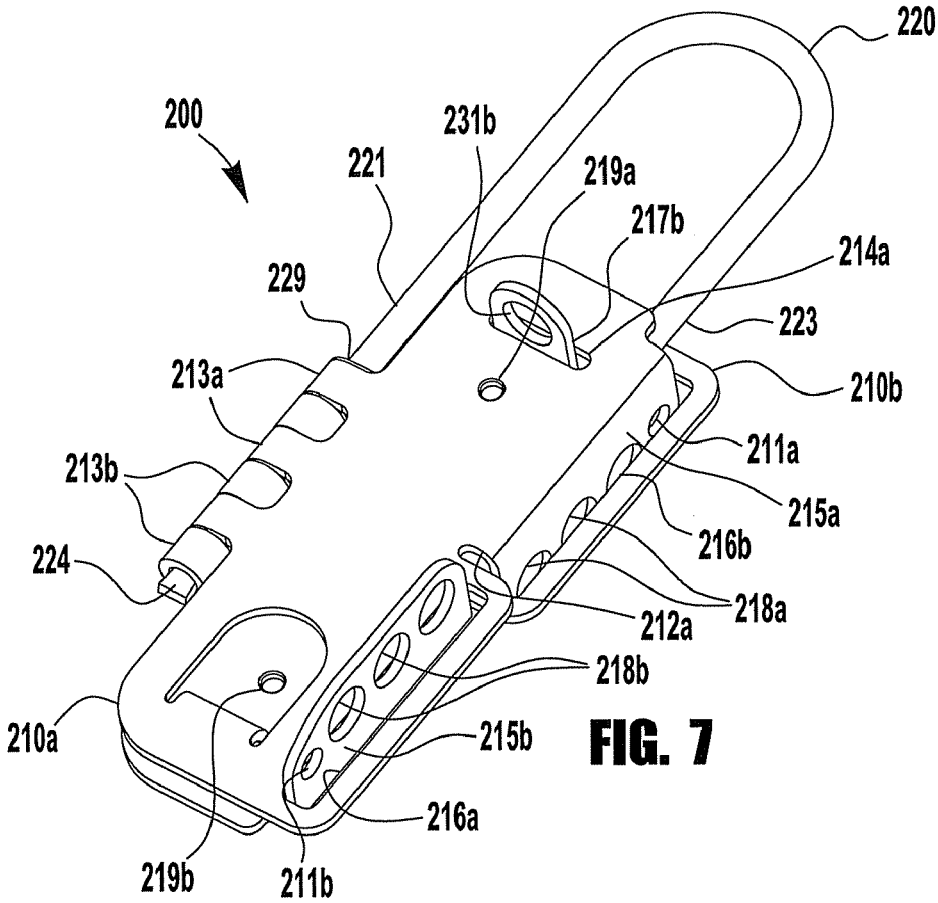
FIG. 7 illustrates a front perspective view of a safety lockout hasp, shown in a closed position.
Figure 8:
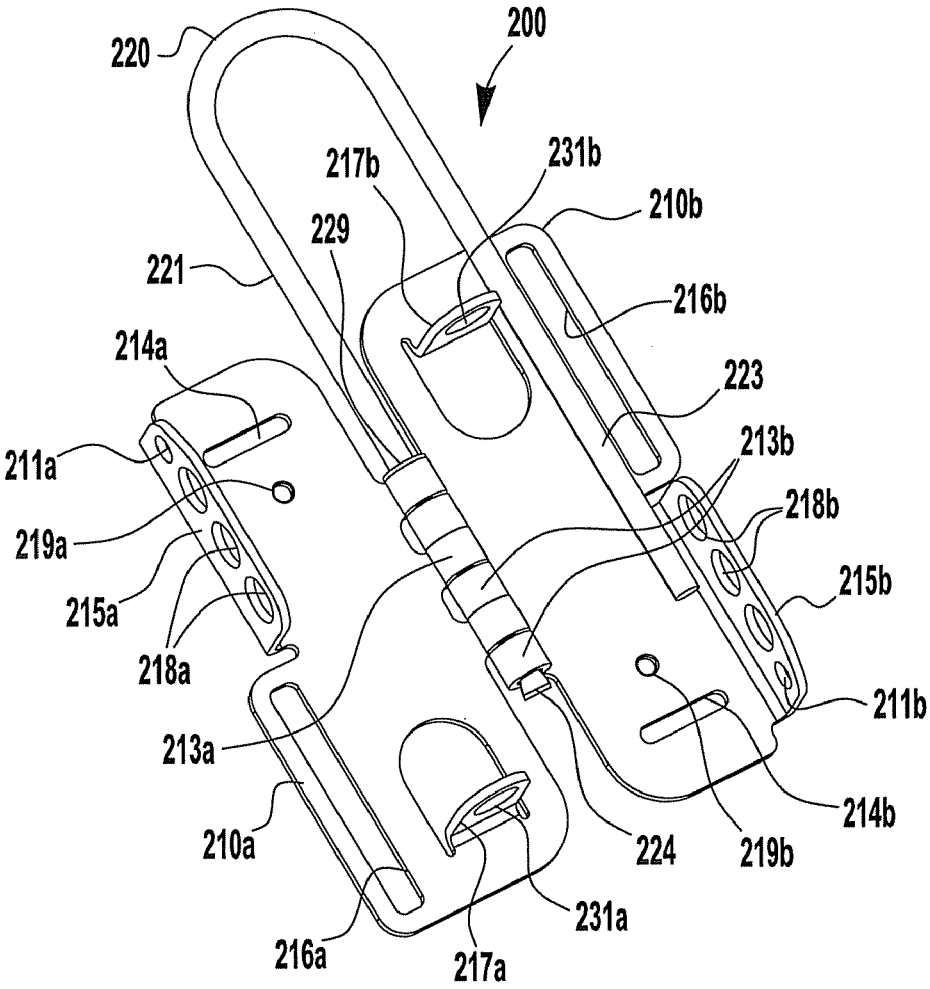
FIG. 8 illustrates a front perspective view of the safety lockout hasp of FIG. 7, shown in an open position.

FIGS. 7 and 8 illustrate another exemplary safety lockout hasp 200 including many of the inventive features described herein. The lockout hasp 200 includes first and second clasp members 210*a*, 210*b* pivotally or hingedly secured to a shackle member 220. The clasp members 210*a*, 210*b* are rotatable about the shackle between a closed position (as shown in FIG. 7) and an open position (FIG. 8).

The first and second clasp members 210*a*, 210*b* may be provided in a wide variety of combinations of sizes and shapes. In the illustrated embodiment, each clasp member 210*a*, 210*b* is provided with a first apertured flange 215*a*, 215*b* that extends laterally from (or substantially perpendicular to) a shackle abutting portion 212*a*, 212*b* of the clasp member 210*a*, 210*b*. The first apertured flanges 215*a*, 215*b* are positioned substantially parallel to, and laterally outward of, the second shackle leg 223 when the first and second clasp members 210*a*, 210*b* are in the closed position. Each clasp member is additionally provided with a second laterally extending apertured flange 217*a*, 217*b* positioned substantially perpendicularly to, and laterally inward of, the second shackle leg 223 when the first and second clasp members 210*a*, 210*b* are in the closed position. Further, each clasp member 210*a*, 210*b* includes a first cutout portion 216*a*, 216*b* (e.g., a slot, hole, or notch) to accommodate the first apertured flange 215*a*, 215*b* of the other clasp member 210*a*, 210*b*, and a second cutout portion 214*a*, 214*b* (e.g., a slot, hole, or notch) to accommodate the second apertured flange 217*a*, 217*b* of the other clasp member 210*a*, 210*b*. The second apertured flanges 217*a*, 217*b* may be dedicated for use with a specific lockable retaining member, such as a supervisor's lock. As shown, the first and second clasp members 210*a*, 210*b* may be substantially identical, which may reduce costs associated with tooling, manufacturing, and storage of inventory. Other quantities of apertured flanges, cutouts, and lockout apertures may additionally or alternatively be provided.

When one or more lockable retaining members (e.g., a padlock shackle, locking cable, or plastic tie) are secured through one or more lockout apertures 218*a*, 218*b*, 211*a*, 211*b*, 231*a*, 231*b* in one or more of the flanges 215*a*, 215*b*, 217*a*, 217*b*, withdrawal of the flanges 215*a*, 215*b*, 217*a*, 217*b* from the corresponding cutout portions 216*a*, 216*b*, 214*a*, 214*b* is prevented, thereby securing the clasp members 210*a*, 210*b* in a closed position. This prevents removal of the lockout hasp 200 from the equipment lockout feature to which the lockout hasp 200 is secured. In the illustrated embodiment, the first apertured flanges 215*a*, 215*b* are each provided with three larger lockout apertures 218*a*, 218*b* and one smaller lockout aperture 211*a*, 211*b*, and the second apertured flanges 217*a*, 217*b* are each provided with one lockout aperture 231*a*, 231*b*. However, other sizes, quantities or combinations of lockout apertures may be provided on either one or both of the apertured flanges. The lockout apertures 218*a*, 218*b*, 211*a*, 211*b*, 231*a*, 231*b* may be sized large enough to accommodate a range of sizes of retaining members (including, for example, an 8 mm diameter shackle), but small enough to prevent excessive rotation of the locked clasp members (and resulting separation from the shackle member 220) when a smaller retaining member (such as, for example, a plastic tie) is secured through the aperture 218*a*, 218*b*, 211*a*, 211*b*, 231*a*, 231*b*.

Figure 9:
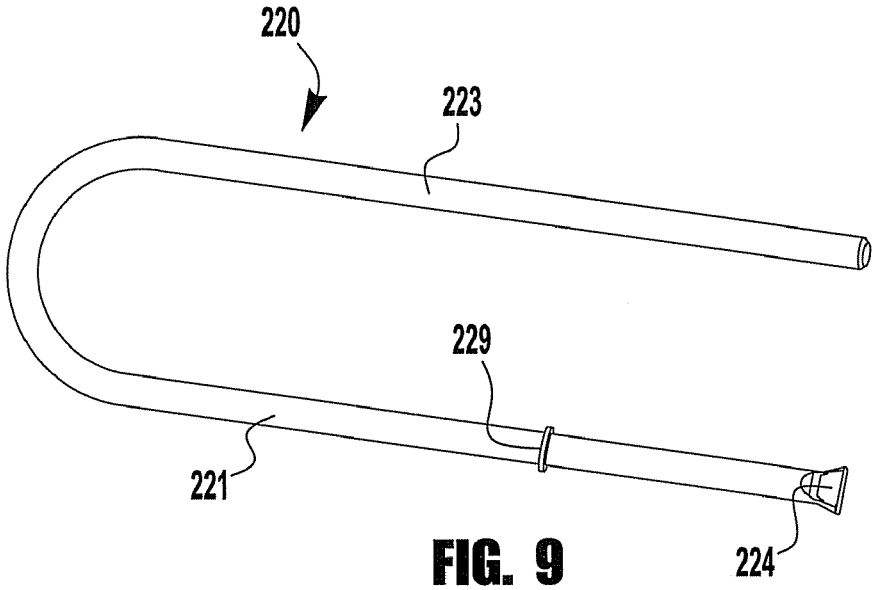
FIG. 9 illustrates a perspective view of the shackle and retaining ring of the safety lockout hasp of FIG. 7.

Many different configurations may be utilized to axially secure the clasp members 210*a*, 210*b* on the shackle 220 while permitting rotation of the clasp members 210*a*, 210*b* about the shackle 220. In the embodiment of FIGS. 7 and 8, the clasp members 210*a*, 210*b* each include axially extending hinge portions 213*a*, 213*b* for insertion of the first shackle leg 221 therethrough. As shown in FIG. 9, an end 224 of the shackle leg 221 may be flanged or peened to retain the clasp members 210*a*, 210*b* on the shackle 220, and a retaining ring 229 may be installed on the shackle 220 to prevent movement of the clasp members 210*a*, 210*b* upward on the shackle 220.

While the shackle 220 may be provided in many different sizes, in one embodiment, the shackle 220 is approximately 4 mm in diameter, to accommodate, for example, the smaller standard lockout apertures of conventional ISO/DIN type equipment. By providing a shackle 220 having a smaller diameter than the size of padlock shackle (or other retaining member) accommodated by the lockout apertures 218*a*, 218*b*, the safety lockout hasp 200 may be used as a type of adapter for padlocks (or other locks) having shackles (or other retaining members) that are too large to fit in a smaller lockout aperture. Further, the apertured flanges 215*a*, 215*b*, 217*a*, 217*b*, may be provided with at least one smaller diameter lockout aperture 211*a*, 211*b*, such that a smaller diameter shackle of a second safety lockout hasp (which may, but need not, be identical to one of the illustrated safety lockout hasps 100, 200) may be tightly secured to, or "daisy-chained" with, the safety lockout hasp 200 to provide for still more lockout apertures.

While the lockout hasp components may be provided in many different materials, in one embodiment, the shackle 220 and clasp members 210*a*, 210*b* are provided in metal, such as, for example, steel or aluminum. The safety lockout hasp components may be provided in many different sizes, shapes, and dimensional configurations, for example, to accommodate different equipment lockout apertures and padlocks or other retaining members.

Additional features may also be provided. For example, as shown in the illustrated embodiment, an additional hole 219*a*, 219*b* may be provided on each clasp member 210*a*, 210*b* to facilitate fastening of an identification tag to the lockout device. As another example, a slight interference fit may be provided between the first apertured flanges 215*a*, 215*b* and the second shackle leg 223 when the clasp members 210*a*, 210*b* are in a closed position, to retain the clasp members in the closed position during installation.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A safety lockout hasp comprising:

a shackle member having a first shackle leg and a second shackle leg;

a first clasp member pivotally secured to the first shackle leg, the first clasp member including an apertured flange and a cutout portion;

a second clasp member pivotally secured to the first shackle leg, the second clasp member including an apertured flange and a cutout portion;

wherein when the first and second clasp members are in a closed position, at least one of the first and second clasp members engages the second shackle leg;

further wherein when the first and second clasp members are in the closed position, the apertured flange of the first clasp member extends outward through the cutout portion of the second clasp member and the apertured flange of the second clasp member extends outward through the cutout portion of the first clasp member, such that insertion of a lockable retaining member through a lockout aperture in one of the apertured flanges prevents withdrawal of the one of the apertured flanges from the corresponding cutout portion, thereby securing the first and second clasp members in the closed position.

2. The safety lockout hasp of claim 1, wherein the second clasp member is substantially identical to the first clasp member.

3. The safety lockout hasp of claim 1, wherein the apertured flange of the first clasp member is substantially collinear with the cutout portion of the first clasp member.

4. The safety lockout hasp of claim 1, wherein the apertured flanges of the first and second clasp members substantially cover a laterally outermost surface of the second shackle leg when the first and second clasp members are in the closed position.

5. The safety lockout hasp of claim 1, wherein the apertured flanges of the first and second clasp members extend in opposite directions when the first and second clasp members are in the closed position.

6. The safety lockout hasp of claim 1, wherein the apertured flanges of the first and second clasp members extend substantially parallel to the second shackle leg.

7. The safety lockout hasp of claim 1, wherein the apertured flanges of the first and second clasp members extend substantially perpendicularly to the second shackle leg.

8. The safety lockout hasp of claim 1, wherein at least a portion of the first clasp member is positioned to provide an interference fit with the second leg of the shackle member when the first clasp member is in the closed position.

9. The safety lockout hasp of claim 1, wherein the first and second clasp members include shackle receiving passages and inwardly biased projections extending into the shackle receiving passages to interlock with upper and lower grooves in the first shackle leg disposed within the shackle receiving passages for pivotally securing the first and second clasp members with the first shackle leg.

10. The safety lockout hasp of claim 9, wherein the lower groove includes a chamfered upper edge.

11. The safety lockout hasp of claim 1, wherein at least one of the apertured flanges comprises a plurality of lockout apertures.

12. The safety lockout hasp of claim 1, wherein at least one of the apertured flanges comprises a first lockout aperture and a second lockout aperture smaller than the first lockout aperture.

13. The safety lockout hasp of claim 1, wherein the first clasp member comprises first and second apertured flanges, and the second clasp member comprises first and second cutout portions positioned to receive the first and second apertured flanges therethrough when the first and second clasp members are in the closed position.

14. The safety lockout hasp of claim 13, wherein the first apertured flange is substantially perpendicular to the second apertured flange.

15. A safety lockout hasp comprising:

a shackle member having a first shackle leg and a second shackle leg;

a first clasp member pivotally secured to the first shackle leg, the first clasp member including an apertured flange;

a second clasp member pivotally secured to the first shackle leg, the second clasp member including a cutout portion;

wherein when the first and second clasp members are in a closed position, at least one of the first and second clasp members engages the second shackle leg;

further wherein when the first and second clasp members are in the closed position, the apertured flange of the first clasp member extends outward through the cutout portion of the second clasp member, such that insertion of a lockable retaining member through a lockout aperture in the apertured flange prevents withdrawal of the apertured flange from the cutout portion, thereby securing the first and second clasp members in the closed position; and further wherein the first and second clasp members include shackle receiving passages and inwardly biased projections extending into the shackle receiving passages to interlock with upper and lower grooves in the first shackle leg disposed within the shackle receiving passages for pivotally securing the first and second clasp members with the first shackle leg.

16. The safety lockout has of claim 15, wherein the lower groove includes a chamfered upper edge.

* * * * *